US005440668A

United States Patent [19]

Jones

[11] Patent Number: 5,440,668

[45] Date of Patent: Aug. 8, 1995

[54] ELECTRODE BOILER WITH AUTOMATIC DRAIN CONTROL RESPONSIVE TO MEASURED ELECTRODE CURRENT

[75] Inventor: Howard C. Jones, Haywards Heath, England

[73] Assignee: Eaton-Williams Group Limited, Edenbridge, England

[21] Appl. No.: 198,260

[22] Filed: Feb. 18, 1994

[30] Foreign Application Priority Data

Feb. 23, 1993 [GB] United Kingdom ..... 9303582

[51] Int. Cl.[6] ..... F22B 1/30; F22D 5/26

[52] U.S. Cl. ..... 392/327

[58] Field of Search ..... 392/325–331

[56] References Cited

U.S. PATENT DOCUMENTS

| | | | |
|---|---|---|---|
| 3,682,141 | 8/1972 | Johansen | 392/326 |
| 3,780,261 | 12/1973 | Eaton-Williams | 392/326 |
| 3,937,920 | 2/1976 | Gundacker et al. | 392/326 |
| 3,944,785 | 3/1976 | Eaton-Williams | 392/326 |
| 4,196,341 | 4/1980 | Williams | 392/326 |
| 4,347,430 | 8/1982 | Howard-Leicester . | |
| 4,418,269 | 11/1983 | Eaton-Williams | 392/326 |
| 4,675,505 | 6/1987 | Fischer | 392/326 |
| 4,952,779 | 8/1990 | Eaton-Williams | 392/326 |

*Primary Examiner*—John A. Jeffery

*Attorney, Agent, or Firm*—Dickinson, Wright, Moon, Van Dusen & Freeman

[57] ABSTRACT

An electrode boiler comprises a container for containing water and electrodes within the container which serves to pass electrical current through such water and which is generally upright when in use. Feed and drain systems are connected to the container to enable water to be fed to and drained therefrom. An outlet is provided through which steam generated inside the container can pass. An electrode current indicator provides an indication of the value of the electrical current passing through the electrodes. A controlling computer is connected to the feed and drain systems and the electrode current indicator. The controlling computer is set to cause the feed system to open when a predetermined drop in the electrode current has occurred owing to a boiling away of water from the boiler, and then to cause the feed system to close when a predetermined increase in the electrode current has occurred owing to the introduction of water into the boiler. Current-increase-rate measuring device is provided in the controlling computer to provide a measure of the rate of increase of electrode current when the feed system is opened. The controlling computer is to open the drain system, for a drain period, in dependence upon the measured value of the current-increase-rate.

23 Claims, 4 Drawing Sheets

ELECTRODE BOILER WITH AUTOMATIC DRAIN CONTROL RESPONSIVE TO MEASURED ELECTRODE CURRENT

The present invention relates to electrode boilers with automatic control, for example for use in controlling the humidity of the air in a building.

One such electrode boiler has previously been proposed, for example, in U.S. Pat. No. 4,347,430, in which current is supplied to its electrodes to cause the water held therein to boil away. When the water in the boiler has boiled away to a certain level, fresh water is supplied to the boiler container, which is generally in the form of a cylinder, to refill it. This process is repeated. As a result the concentration of electrolytes in the water increase until a desired current level is reached when the cylinder is full as indicated by a cylinder full pin, which causes a signal to be issued when the water in the cylinder reaches that pin. Thereafter, the water in the cylinder is boiled away. As a result, the water level drops, the lengths of the electrodes which are immersed in the water decreases, and so thus does the current through the electrodes. Once the current falls to a predetermined percentage of the desired current below that current value, fresh water is introduced into the cylinder until the desired current value is restored. This boil/fill cycle is repeated to produce the desired amount of steam from the cylinder. A lower demand can be satisfied simply by reducing the level of the water in the cylinder relative to the maximum demand. However, as time progresses, the electrolytic content of the water increases, so that a given electrical current through the electrodes (corresponding to the demand for steam) occurs at successively lower water levels in the cylinder, with resulting loss of efficiency and increased likelihood of erosion of the electrodes. In the automatic control described in U.S. Pat. No. 4,347,430, this situation is recognised by the very much reduced period of the boil/fill cycle. Once that period falls to a predetermined value relative to the value it had at full demand and cylinder full, water is drained from the cylinder before fresh water is introduced, to reduce the electrolytic content of the water in the cylinder.

Now the period of the boil/fill cycle is dependent on many factors. Spurious values may occur owing to the unstable conditions of the system during boil away, so that the efficiency of operation of the boiler is reduced.

It is an aim of the present invention to provide a remedy in a cost effective manner.

Accordingly, the present invention is directed to an electrode boiler comprising a container for containing water, electrodes within the container which serve to pass electrical current through such water and which extend in a generally vertical direction when the boiler is in use, feed and drain means connected to the container to enable water to be fed to and drained from the container, outlet means of the container through which steam generated inside the container can pass when the boiler is in use, an electrode current indicator arranged to provide an indication of the value of the electrical current passing through the electrodes, and control means connected to the feed and drain means and the electrode current indicator, in which the control means are such as to cause the feed means to open when a predetermined drop in the electrode current has occurred owing to a boiling away of water from the boiler, and then to cause the feed means to close when a predetermined increase in the electrode current has occurred owing to the introduction of water into the boiler through the feed means, in which current-increase-rate measuring means are provided in the control means to provide a measure of the rate of increase of electrode current when the feed means are open, and in which the control means are such as to open the drain means, for a drain period, in dependence upon the said measure.

Preferably, the said measure is the time it takes for the said predetermined increase in electrode current to occur. Alternatively, it may be the increase in electrode current that occurs over a predetermined interval while the feed means are open or alternatively it may be the gradient of electrode current as a function of time when the feed means are open.

If a value of the said measure is provided every time the feed means are open, then an inhibit latch may be provided in the control means to inhibit opening of the drain means until a predetermined number, preferably 15, of boil/fill cycles have occurred after a desired electrode current has been reached.

The said measure may be a rolling average of values taken from a predetermined number, preferably 5, of the most recent boil/fill cycles.

Advantageously, the control means are such as to open the drain means, for a drain period, upon the occurrence of a decrease in the value of a parameter which varies with the inverse of the said measure.

The said parameter may be given by the expression REF/FT, in which REF is a reference value stored in the control means, and FT is the feed time for which the feed means are open during a boil/fill cycle.

If REF is the value of the feed time at the start of operation of the boiler once the desired electrode current has been reached then REF/FT is an indication of the concentration of the electrolytic contents of the water in the boiler in terms of the initial value it had at start up with the desired current having been reached.

Preferably, the said parameter is given by $CN=REF/FT_{RA}$ in which CN is the value of the parameter, and $FT_{RA}$ is a rolling average of the feed time.

Advantageously, the said parameter is given by $CN=REF/10(FT_{RA}/\Delta I)$ in which $\Delta I$ is the said predetermined drop and/or the said predetermined increase, the said predetermined increase in any case being substantially equal to the said predetermined drop whilst the boiler is operating in a state of dynamic equilibrium, and preferably being 10%.

In the event that such a decrease in the value of the said parameter occurs before the value of that parameter has reached a predetermined value, preferably a value of 1.5, then the value of REF may be reset. The new value it has may be given by the equation $$REF_{new}=10(REF_{init}-FT_{RA\ current})/CF,$$

in which $REF_{new}$ is the new reference value, $REF_{init}$ is the value it had, $FT_{RA\ current}$ is the most recent value of $FT_{RA}$, and CF is a value of concentration given by a table of values stored in a memory of the control means, such that CF has a value of about 3 for operation conditions in which the electrode current is set to be 100% of the desired maximum current when the boiler is full, and a value of about 1.5 for operation conditions in which the electrode current is set to be at about 22% of that desired maximum current, the values of CF between those points increasing exponentially.

The present invention also extends to a method of operating an electrode boiler as set out in the immediately preceding paragraphs.

An example of an electrode boiler made in accordance with the present invention will now be described with reference to the accompanying drawings, in which.

Figure 1:
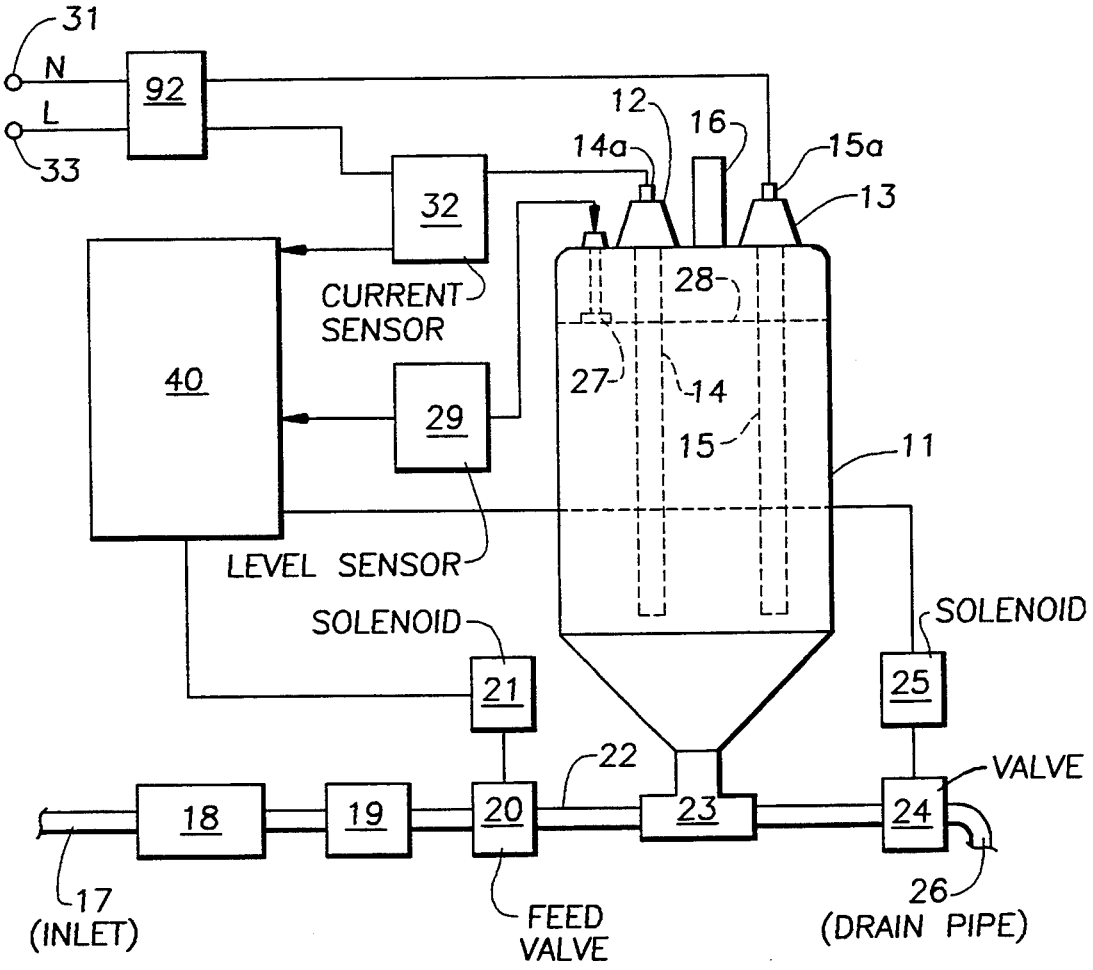
FIG. 1 shows a part elevational, part block circuit diagram of the example.

Referring to FIG. 1, the electrode boiler comprises a container 11, which may conveniently be made of synthetic plastics material, the general structure of the boiler being inexpensive so that when it is thoroughly contaminated with solid matter it may be thrown away or recycled rather than dismantled and descaled. The moulded container includes bushes 12 and 13 which support electrodes 14 and 15 (shown dotted) inside the boiler and have respective electrical connections 14*a*, 15*a* at their upper ends. These electrodes are shown as cylinders for convenience but they may be comprised of rolls or other structures of wire mesh and may be of any desired shape, to provide particular boiler characteristics. Only two electrodes are shown, for use with a single phase alternating current supply, but more electrodes may be provided for connection to a polyphase supply. The boiler may be of any desired shape and size but one desired shape for the boiler is a cylinder which is upright when in use so that the volume of water in the boiler varies linearly with the height of the water in the boiler, and a convenient size which has a large field of application holds about ten liters of water with a "boiling space" at the top. At the top of the container is a moulded-on tube 16 through which steam is discharged at substantially atmospheric pressure for use in an air conditioning system. However, if the boiler discharges into a steam hose or into a duct through which air is being blown by a fan the steam discharge might not be quite at atmospheric pressure.

Water is supplied to the boiler through an inlet pipe 17 leading to a strainer 18 from which the water flows through a flow regulator 19. This may conveniently be an automatic flow or pressure regulating device of a kind which is available on the market. From the flow regulator 19 the water passes to an electrically controlled feed valve 20 actuated by a solenoid 21. The water then passes through a pipe 22 to one arm of a "T" piece 23 fixed to the bottom of the container 11. The other arm of the "T" piece 23 forms an outlet and this is connected to a second electrically controlled valve 24 actuated by a solenoid 25. Water passing through the valve 24 passes into a drain pipe 26.

A level sensing electrode 27 is included in the container 11 in order to provide a "boiler full" signal when the water is at the level indicated by the dotted line 28. The sensing electrode 27 is connected to level sensing means 29 which in turn is connected is connected to electronic control means 40.

The electrode 15 is connected to the neutral line 31 of a mains supply network while the electrode 14 is connected through a current sensing device 32 to the live conductor 33 of the supply. The current sensing device could be a resistor, means being provided to sense the voltage drop across the resistor, but it is preferred to use a current transformer.

Figure 2:
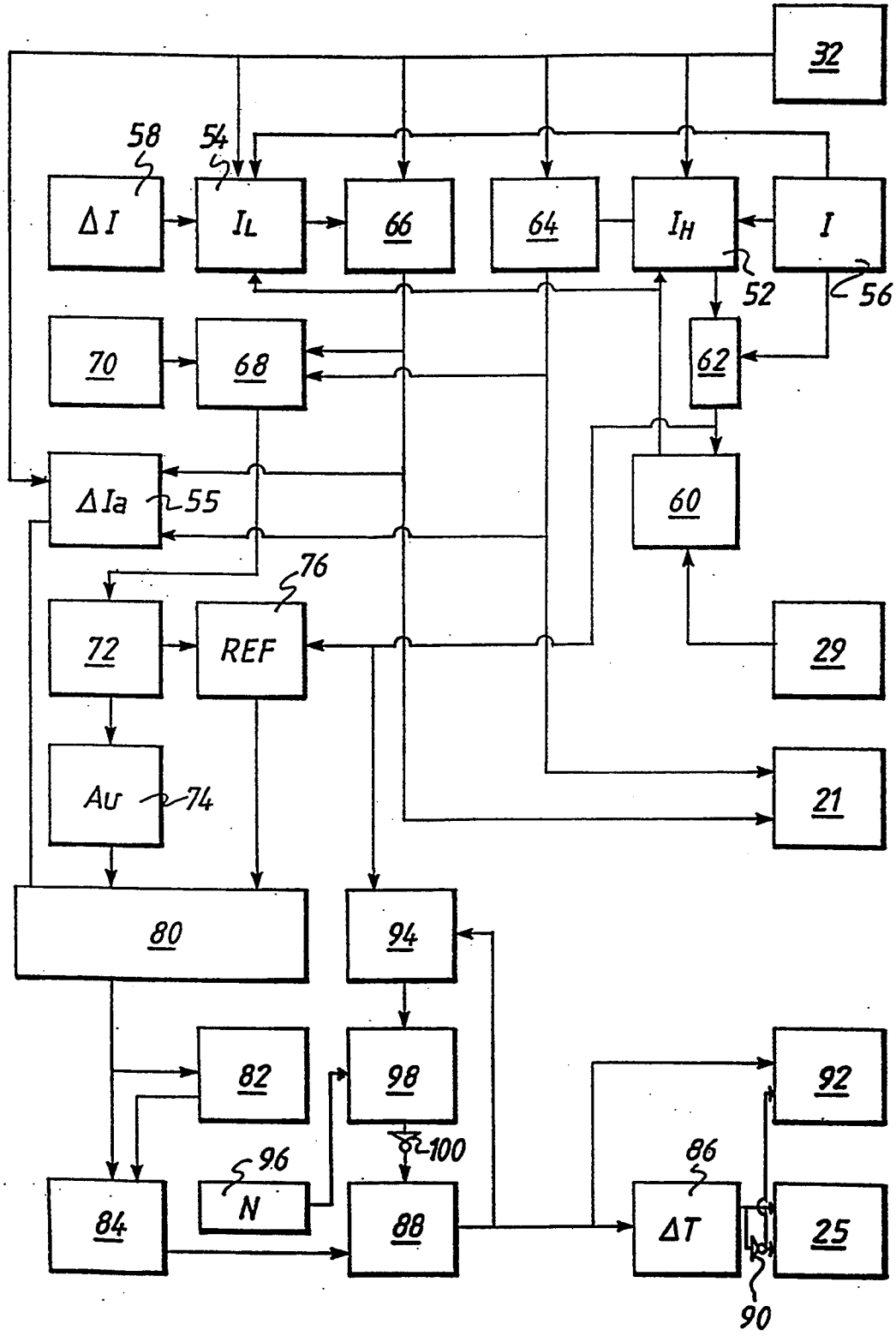
FIG. 2 shows a block circuit diagram of control means of the circuitry shown in FIG. 1.

The electronic control means 40 is shown in greater detail in FIG. 2. An output from the current sensing device 32 is connected to respective read inputs of first and second RAM memories 52 and 54, in which are stored a high current reference value and a low reference value, $I_H$ and $I_L$, respectively. The output from the current sensing device 32 is also connected to the input of a calculator 55 which is such as to calculate the actual percentage difference, $\Delta I_A$, between two values of current it receives from the current sensing device 32, as will be described in greater detail hereinafter.

The RAM memories 52 and 54 each have respective further setting inputs connected to the output of a manually adjustable reference current memory 56. In addition the RAM memory 54 has a further setting input connected to an output of a reference current change memory 58.

An output from the level sensing means 29 is connected to respective setting inputs of the RAM memories 52 and 54 via an inhibitor 60. The latter has an inhibiting input connected to the output of a comparator 62 which in turn has respective inputs connected to receive the values for the time being stored in the memory 52 and the memory 56.

The output from the current sensing device 32 is also connected to respective inputs of two comparators 64 and 66 which have respective second inputs connected to the outputs from the $I_H$ and $I_L$ memories 52 and 54. Outputs from the comparators 64 and 66 are connected respectively to close and open inputs of the solenoid 21, and also to setting inputs of the calculator 55, so that the two values of current compared by the calculator 55 are those at the beginning and at the end of a water feed to the boiler container 11.

Start and end inputs of a counter 68 are connected respectively to the outputs of the comparators 64 and 66, and an input to the counter is connected to the output of a clock 70, so that the counter counts pulses received from the clock 70 from the time the solenoid 21 opens the valve 20 to the time it closes that valve. The counter 68 is reset each time it receives a start signal, at the beginning of a count, and sends a signal from its output every time it receives an end signal. The counter 68 and clock 70 therefore constitute a timer that provides a measure of the time of a feed of water to the boiler container 11.

The output from the counter 68 is connected to the input of a memory 72 which in turn has an output connected to an averaging circuit 74 which provides a signal at its output which is indicative of the rolling average value ($FT_{RA}$) of the last five counts received by the memory 72 from the counter 68. An output from the memory 72 is also connected to a reference memory 76 which stores the first value (REF) of the count received by the memory 72 from the counter 68 upon receipt by the reference memory 76 of a setting signal from the comparator 62.

The calculator 80 is connected to receive outputs from the $\Delta I_A$ calculator 55, the average circuit 74 and the reference memory 76. The calculator 80 is such as to provide a signal at its output which is indicative of the value of the eletrolytic concentration of the water in the boiler container 11 as given by the expression:

$$REF/10(FT_{RA}/\Delta I_a)$$

The output from the calculator 80 is passed to the input of a further RAM memory 82 and a comparator 84. The latter is connected to compare a signal directly from the calculator 80 and a signal from the memory 82 which is indicative of the proceeding value of the signal issued by the calculator 80. The comparator 84 issues an output signal from its output in the event that the signal from the calculator 80 is lower than the signal from the RAM memory 82.

A time delay switch 86 has a triggering input connect to an output of the comparator 84 via an inhibitor 88. Once triggered, the time delay switch 86 issues a signal from its output for a predetermined period to an open input of the solenoid 25 of the drain valve 24. A close input of the solenoid 2S is also connected to the output of the time delay switch 86 via a negator 90 so that the close input of the solenoid 25 receives a single at the end of the time delay period. Outputs from the inhibitor 88 and the negator 90 are connected respectively to on and off inputs of a power adjuster 92 connected to deliver adjustable power to the electrodes 14 and 15.

A setting input of a counter 94 is connected to the output of the comparator 62. The main input to the counter 94 is connected to the output from the comparator 62, and a reset input to the counter 94 is connected to the output from the inhibitor 88. A RAM memory 96 stores a predetermined number, preferably 15, but that number is manually adjustable. Respective outputs from the counter 94 and the memory 96 are connected to respective inputs of a comparator 98 which is connected to the inhibitor 88 through a negator 100 so that the inhibitor inhibits signals from the comparator 84 reaching the time delay switch 86 until the count in the counter 94 reaches the value stored in the memory 96.

It will also be appreciated that the various components of the control means 40 may be parts of a duly programmed microprocessor.

The manner in which the control means 40 operates the boiler will now be described with reference to the graphs shown in FIGS. 3 to 6 as well as to the apparatus and circuitry itself shown in FIGS. 1 and 2.

At start-up, the value $I_H$ stored in the memory 52 will be that set by the manually adjustable memory 56, and the value $I_L$ stored in the memory 54 will be that set by the combination of the memory value stored in memories 56 and 58, such that $I_L$ is lower than $I_H$ by a percentage $\Delta I$, preferably 10%.

Since the current passing through the electrodes will initially be zero, the output from the sensor 32 will also be zero, substantially less than the value $I_L$ stored in the memory 54. Since the comparator 66 is such as to provide a signal at its output whilst the signal from the sensor 32 represents a lower value than that from the memory 54, a signal from the comparator 66 is issued to the open input of the solenoid 21. Water is therefore fed into the container 11.

When the water level in the container 11 reaches the level sensing electrode 27, a signal is issued from the level sensing means 29 via the inhibitor 60 to the respective setting inputs of the memory 52 and 54. This temporarily resets the values stored in those memories to values which are respectively (a) the value for the time being issued from the sensing device 32, and (b) a value which is lower than that by the percentage represented by the $\Delta I$ value stored in the memory 58. As a result, the output from the memory 54 is now lower than that from the sensing device 32, and no signal is issued by the comparator 66. However, the signals received by the comparator 64 are now equal, and since the comparator 64 is so arranged to issue a signal when the value it receives from the sensing device 32 is equal to or greater than that which it receives from the memory 52, a signal is issued by the comparator 66 to the closing input of the solenoid 21.

The heat generated by the current passing through the electrodes 14 and 15 will now boil water away so that the level of the water falls and consequently so does the current passing through the electrodes 14 and 15. Eventually, therefore, the current will reach the value $I_L$ for the time being set in the memory 54, whereupon an open signal is sent by the comparator 66 to the solenoid 21 to open the valve and feed water to the boiler container 11. This procedure is repeated, so that the electrolytic concentration of the water in the boiler container 11 increases, with a consequent rise in the current each time the sensing electrode 27 indicates that the boiler container 11 is full.

Eventually, the value of $I_H$ temporarily stored in the memory 52 reaches the value of I stored in the memory 56, whereupon a signal is issued from the comparator 62. This switches on the inhibitor 60 so that no further setting signals pass from the sensing means 29 to the memory 52 and 54, whereafter the value stored in those memories are set to the value stored in the memory 56, and that value decreased by the percentage $\Delta I$ stored in the memory 58, respectively.

Thereafter, the solenoid 21 will be operated by the comparators 64 and 66 to open the feed valve 20 every time the current drops to a value $I_L$, and to close it every time it reaches the higher current value $I_H$. Between each successive feed period, current passing through the electrodes boils the water away from the container 11. Since the electrolytic concentration continues to build up, the water level for any given current value falls as operation of the boiler proceeds.

Figure 3:
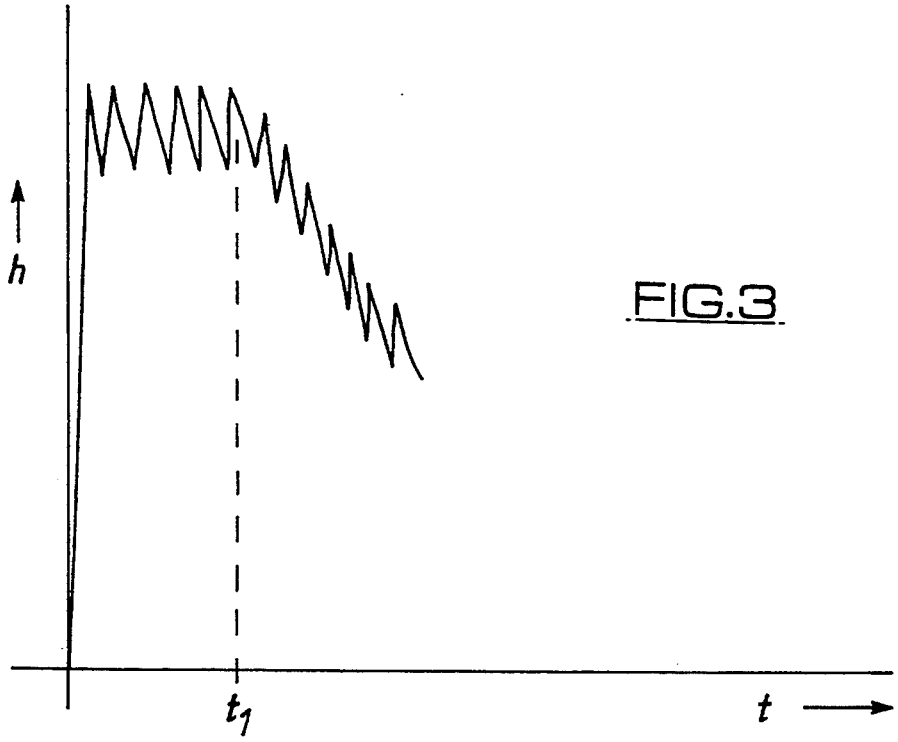
FIGS. 3 to 6 show respective explanatory graphs.

FIG. 3 shows diagrammatically the variation of water level with time. From start-up up until time $t_1$, the electrolytic concentration is built up until the desired current level at boiler full is reached. Thereafter, although the water level rises and falls with each successive feed period and boil away period of successive feed/boil cycles, the mean level falls with time in proportion to the increase in electrolytic concentration in the water.

Figure 4:
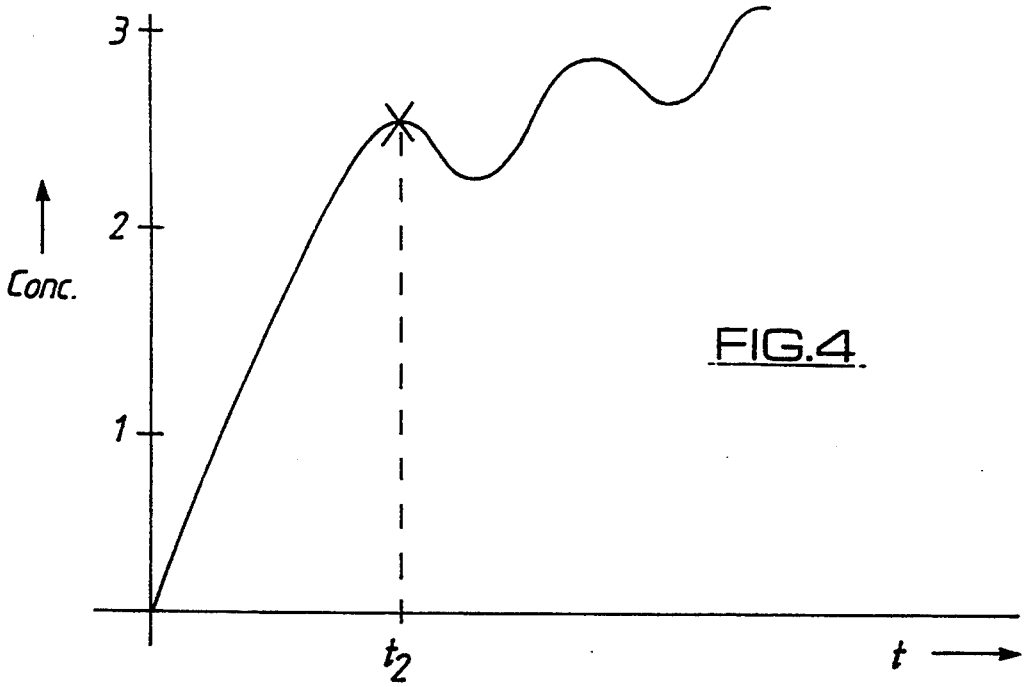

FIG. 4 shows the increase of concentration with time, the value of concentration in this particular graph being represented in units of a concentration value of water in the container at the end of the start-up period when the desired current is reached with the boiler full.

It would be expected that the concentration would continue to rise linearly with time. However, experimentally this has been found not to be the case, and in fact the concentration value peaks at time $t_2$ and then bottoms-out and peaks again in a series of troughs and peaks.

The control means 40 shown in FIG. 2 are constructed to cause a draining to occur at or immediately after time $t_2$, when the concentration peaks for the first time. It does this by noting when the value of the signal issued by the calculator 80 is lower than the immediately proceeding value it had, bearing in mind that the first fifteen comparisons after the start-up period or after a subsequent draining are disregarded by virtue of the effect of the inhibitor 88. Thus, a draining occurs directly following the concentration peaks.

Figure 5:
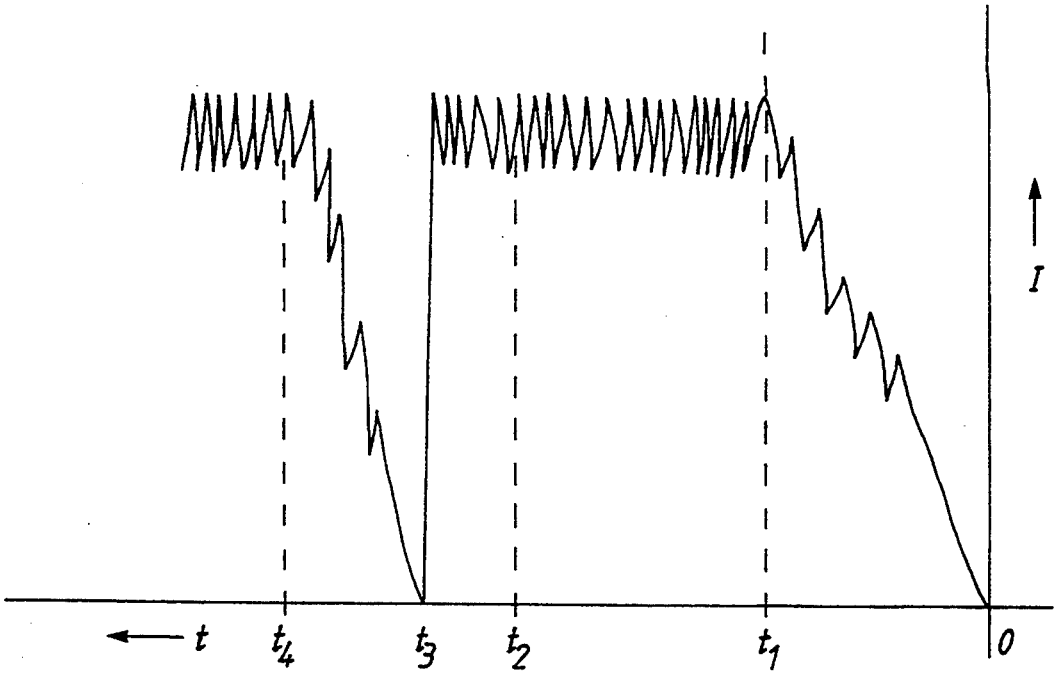

The resulting variation of electrode current with time is shown in the graph of FIG. 5. The period 0 to $t_1$ represents the start-up procedure. The period $t_1$ to $t_2$ represents the full fifteen boil/fill cycles during which the inhibitor 88 prevents signals from the calculator 80 reaching the time delay switch 86. The time $t_3$ is the time at which the concentration peaks, whereupon a drain occurs and the electrical current to the electrodes 14 and 15 is switched off. The period $t_3$ to $t_4$ corresponds to the period 0–$t_1$ upon start-up.

Further circuitry may be provided to adjust the period of the time delay switch 86 in the event that it is found that the draining is not adequate.

Figure 6:
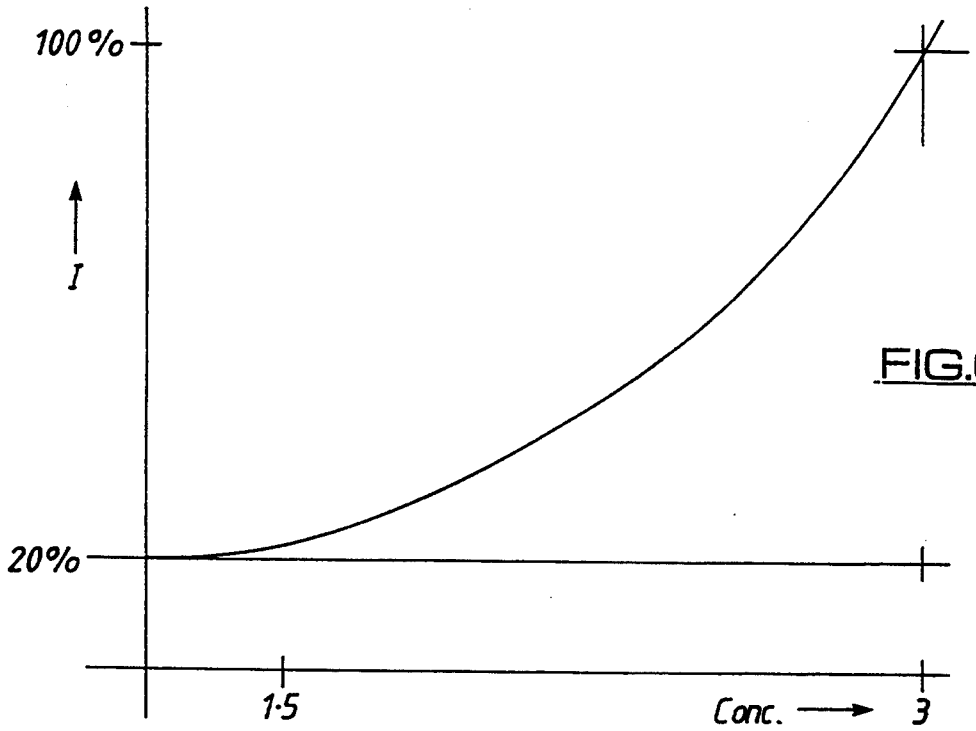

In the event that the REF value stored in the memory 76 results in a peak occurring at a concentration value indicated by the calculator 80 which is less than 1.5, circuitry (not shown) may be provided to reset the REF value stored in the memory 76, according to the following expression:

$$REF_{new}=10(REF_{init}-RA)/CNT,$$

in which $REF_{new}$ is the new value of REF stored in the memory 76, $REF_{init}$ is the initial value that was stored in the memory 76, RA is the adjusted rolling average given by the expression $10(FT_{RA}/\Delta I_a)$ as given in the previous equation for concentration and as indicated by the calculator 55 and the averaging circuit 74, and CNT is a value for concentration given by a "look-up table", being a series of values stored in the control means 40, and being represented by the graph shown in FIG. 6. That graph shows an exponentially increasing % current with respect to concentration. The current decreases asymptotically with decreasing values of concentration to a value of current which is 20% of the maximum desired current, and increases to the value of 3 when the current is set at 100% of the desired maximum current, so that the value of concentration at a position of desired current a little above 20% of the maximum desired current is 1.5. It will be appreciated in this respect that this allows for the value of I set in the memory 56 to be decreased to a lower value, relative to the maximum desired current, in the event that the demand for steam decreases.

Many modifications and variations to the illustrated boiler will be readily apparent to a person of ordinary skill in the art without taking the modification outside the scope of the present invention. For example, instead of measuring the feed time to bring the electrode current back to a desired value, the control means 40 may be modified so that they measure the increase in current over a predetermined time interval during a feed of water to the boiler container 11, and to use this increase to provide an indication of the electrolytic concentration of the water in the boiler container 11.

Means (not shown) may be provided to increase the electrode power when cold water is introduced into the boiler container 11 to reduce the time it takes for the boiling temperature to be restored. Thus, if a burst firing of the electrodes is used, in which the current is delivered in successive bursts, the length of the bursts may be increased, or the length of periods between bursts may be decreased, to increase the power when cold water is introduced into the boiler container 11.

I claim:

1. An electrode boiler comprising a container for containing water, electrodes within the container which serve to pass electrical current through such water and which extend in a generally vertical direction when the boiler is in use, feed and drain means connected to the container to enable water to be fed to and drained from the container, outlet means of the container through which steam generated inside the container can pass when the boiler is in use, an electrode current indicator arranged to provide an indication of the value of the electrical current passing through the electrodes, and control means connected to the feed and drain means and the electrode current indicator, in which the control means are such as to cause the feed means to open when a predetermined drop in the electrode current has occurred owing to boiling away of water from the boiler, and then to cause the feed means to close when a predetermined increase in the electrode current has occurred owing to the introduction of water into the boiler through the feed means, in which measuring means are provided in the control means to provide a measure of a parameter that varies with the rate of increase of electrode current when the feed means are opened, and in which the control means are such as to open the drain means, for a drain period, upon the occurrence of a change in sense of the gradient of said measure as a function of time.

2. An electrode boiler according to claim 1, in which said measure is the time it takes for the said predetermined increase in electrode current to occur.

3. An electrode boiler according to claim 1, in which said measure is the increase in electrode current that occurs over a predetermined interval while the feed means are open.

4. An electrode boiler according to claim 1, in which said measure is the gradient of electrode current as a function of time when the feed means are open.

5. An electrode boiler according to claim 1, in which a value of said measure is provided every time the feed means are open, and an inhibit latch is provided in the control means to inhibit opening of the drain means until a predetermined number of boil/fill cycles have occurred after a desired electrode current has been reached.

6. An electrode boiler according to claim 5, in which said predetermined number is fifteen.

7. An electrode boiler according to claim 1, in which said measure is a rolling average of values taken from a predetermined number of the most recent boil/fill cycles.

8. An electrode boiler according to claim 7, in which the predetermined number is five.

9. An electrode boiler according to claim 1, in which said parameter is given by the expression REF/FT, in which REF is a reference value stored in the control means, and FT is the feed time for which the feed means are open during a boil/fill cycle.

10. An electrode boiler according to claim 9, in which REF is the value of the feed time at the start of operation of the boiler once the desired electrode current has been reached so that REF/FT is an indication of the concentration of the electrolytic contents of the water in the boiler in terms of the initial value it had at start up with the desired current having been reached.

11. An electrode boiler according to claim 9, in which, in the event that such a decrease in the value of said parameter occurs before the value of that parameter has reached a predetermined value, the value of REF is reset.

12. An electrode boiler according to claim 11, in which said predetermined value is about 1.5.

13. An electrode boiler according to claim 11, in which the new value to which REF is reset is given by the equation $$REF_{new}=10(REF_{init}-FT_{RA\ current})/CF,$$

in which $REF_{new}$ is the new reference value, $REF_{init}$ is the value it had, $FT_{RA\ current}$ is the most recent value of $FT_{RA}$, and CF is a value of concentration which is dependent upon the set value of the electrode current.

14. An electrode boiler according to claim 13, in which the value of CF is given by a table of values stored in a memory of the control means.

15. An electrode boiler according to claim 13, in which CF has a value of about 3 for operation conditions in which the electrode current is set to be 100% of the desired maximum current when the boiler is full, and a value of about 1.5 for operation conditions in which the electrode current is set to be at about 22% of that desired maximum current, the values of CF between those points increasing exponentially.

16. An electrode boiler according to claim 1, in which said parameter is given by $CN=REF/FT_{RA}$ in which REF is the value of the feed time at the start of operation of the boiler once the desired electrode current has been reached, CN is the value of the parameter, and $FT_{RA}$ is a rolling average of the feed time.

17. An electrode boiler according to claim 1 in which said parameter is given by $CN=REF/10\ (FT_{RA}/\Delta I)$ in which REF is the value of the feed time at the start of operation of the boiler once the desired electrode current has been reached, $\Delta I$ is, expressed as a percentage, said predetermined drop or said predetermined increase, said predetermined increase in any case being substantially equal to said predetermined drop whilst the boiler is operating in a state of dynamic equilibrium, CN is the value of the parameter, and $FT_{RA}$ is a rolling average of the feed time.

18. An electrode boiler according to claim 17, in which said predetermined drop or said predetermined increase is about 10%.

19. A method of operating an electrode boiler comprising a container for containing water, electrodes within the container which serve to pass electrical current through such water and which extend in a generally vertical direction when the boiler is in use, feed and drain means connected to the container to enable water to be fed to and drained from the container, outlet means of the container through which steam generated inside the container can pass when the boiler is in use, an electrode current indicator arranged to provide an indication of the value of the electrical current passing through the electrodes, and control means connected to the feed and drain means and the electrode current indicator, the method comprising the steps of:

(a) causing the feed means to open when a predetermined drop in the electrode current has occurred owing to a boiling away of water from the boiler;

(b) causing the feed means to close when a predetermined increase in the electrode current has occurred owing to the introduction of water into the boiler through the feed means; and (c) opening the drain means, for a drain period, in dependence upon the occurrence of a change in sense of the gradient of a measure as a function of time, of a parameter which varies with the rate of increase of electrode current when the feed means are opened.

20. A method according to claim 19 further comprising the step of determining said rate of increase of electrode current by determining the time for a predetermined increase in said electrode current to occur.

21. A method according to claim 19 further comprising the step of determining said rate of increase of electrode current by determining an increase in said electrode current over a predetermined period of time.

22. A method according to claim 19 further comprising the step of determining said rate of increase of electrode current by determining the gradient of said electrode current over time.

23. A method according to claim 19 further comprising the step of inhibiting the opening of the drain means until a predetermined number of boil/fill cycles have occurred after a desired electrode current has been reached.

* * * * *